US005997111A

United States Patent [19]

Jensen et al.

[11] Patent Number: 5,997,111

[45] Date of Patent: Dec. 7, 1999

[54] DISPENSING CONTAINER FOR USE WITH ONE OR MORE STRIP PACKAGES OF MEDICATION

[76] Inventors: Richard B. Jensen; Jason R. Jensen, both of 121 Point W. Blvd., St., St. Charles, Mo. 63301

[21] Appl. No.: 08/966,716

[22] Filed: Nov. 10, 1997

[51] Int. Cl.[6] ..... B65A 61/00

[52] U.S. Cl. ..... 312/34.4; 221/70

[58] Field of Search ..... 221/34, 70, 155, 221/302, 63; 206/534, 535, 536, 538, 534.2, 461; 220/256, 259; 312/34.4, 50, 71

[56] References Cited

U.S. PATENT DOCUMENTS

| | | | |
|---|---|---|---|
| 244,308 | 7/1881 | Reymond . | |
| D. 263,559 | 3/1982 | Poore | D9/3 |
| D. 281,176 | 10/1985 | Sukovich | D20/18 |
| D. 306,825 | 3/1990 | Siegel | D9/345 |
| D. 312,394 | 11/1990 | Hassey | D9/341 |
| D. 322,400 | 12/1991 | Sorensen | D9/415 |
| D. 322,934 | 1/1992 | Kalvelage | D9/341 |
| D. 323,109 | 1/1992 | Kalvelage | D9/341 |
| 693,637 | 2/1902 | Brethour . | |
| 928,356 | 7/1909 | Brown . | |
| 964,782 | 7/1910 | Hull . | |
| 1,208,701 | 12/1916 | Trenner | 312/34.4 |
| 1,409,009 | 3/1922 | Julien . | |
| 1,488,603 | 4/1924 | Kouwenhoven . | |
| 1,553,115 | 9/1925 | Shaw . | |
| 1,562,063 | 11/1925 | Schuter . | |
| 1,597,246 | 8/1926 | Query . | |
| 1,632,852 | 6/1927 | Richter . | |
| 1,803,656 | 5/1931 | Schuler . | |
| 2,143,518 | 1/1939 | Kolin | 214/1 |
| 2,339,115 | 1/1944 | Scherer | 226/2 |
| 2,373,092 | 4/1945 | Avery | 221/70 |
| 2,615,363 | 10/1952 | Martyn | 86/46 |
| 2,637,152 | 5/1953 | Kraus | 53/5 |
| 2,673,805 | 3/1954 | Colman | 99/171 |
| 2,758,756 | 8/1956 | Tea, Jr. | 222/270 |
| 2,801,025 | 7/1957 | Cookson et al. | 221/203 |
| 3,049,224 | 8/1962 | Fredette et al. | 206/42 |
| 3,054,679 | 9/1962 | Bradford | 99/171 |
| 3,086,639 | 4/1963 | Donofrio | 198/33 |
| 3,092,945 | 6/1963 | Wizelman | 53/273 |
| 3,139,712 | 7/1964 | De Woskin | 53/33 |
| 3,143,208 | 8/1964 | Sizemore, Jr. | 206/56 |
| 3,181,739 | 5/1965 | Dye | 222/158 |
| 3,195,284 | 7/1965 | Crane, Jr. | 53/30 |
| 3,199,263 | 8/1965 | Lee | 53/183 |

(List continued on next page.)

FOREIGN PATENT DOCUMENTS

| | | | |
|---|---|---|---|
| 2931006 | 2/1981 | Germany | 312/34.4 |
| 1296608 | 11/1972 | United Kingdom | 221/155 |

OTHER PUBLICATIONS

Operations Manual for Aylward® Feed Systems and Aylward® Frame Assemblies 1992 Aylward Enterprises, Inc.

Aylward Enterprises Leading The Pharmaceutical industry in Blister Pack Feed Systems 1992 Aylward Enterprises, Inc.

Packaging Week New Packs on Trial Nov. 1992.

Packaging Digest Tablet Feeders Win Zeneca Trial Oct. 1993.

Packaging Digest Zeneca Steps up blister–pack through put Mar. 1994.

Uhlmann Up/1 Tablet Packager photographs.

Ivers Lee Model SA Tablet Packager photographs.

*Primary Examiner*—Peter M. Cuomo

*Assistant Examiner*—Gerald A. Anderson

*Attorney, Agent, or Firm*—Suelthaus & Walsh P.C.; John W. Kepler III

[57] ABSTRACT

A dispensing container is provided which is capable of enclosing strip packages of medication while allowing relatively easy access for the dispensing of said medication. The dispensing container is dimensioned such that the dispensing unit is capable of being stored and transported within a drawer of a medication cart without necessitating substantial modification to the drawer.

13 Claims, 5 Drawing Sheets

U.S. PATENT DOCUMENTS

| | | | |
|---|---|---|---|
| 3,231,130 | 1/1966 | Foote | 221/70 |
| 3,250,385 | 5/1966 | Timms | 206/56 |
| 3,281,012 | 10/1966 | Martell | 221/172 |
| 3,314,575 | 4/1967 | Graham | 222/330 |
| 3,370,365 | 2/1968 | Vosbikian | 40/10 |
| 3,503,493 | 3/1970 | Nagy | 206/56 |
| 3,512,332 | 5/1970 | Klein | 53/30 |
| 3,545,164 | 12/1970 | Middleton | 53/26 |
| 3,551,673 | 12/1970 | Siegel | 250/69 |
| 3,566,929 | 3/1971 | Mead | 141/237 |
| 3,628,694 | 12/1971 | Nichols | 221/265 |
| 3,630,346 | 12/1971 | Burnside | 206/56 AB |
| 3,660,962 | 5/1972 | Bliss et al. | 53/30 |
| 3,692,228 | 9/1972 | Spiegel | 229/29 F |
| 3,702,103 | 11/1972 | Price et al. | 113/114 |
| 3,715,856 | 2/1973 | Borel | 53/41 |
| 3,728,842 | 4/1973 | Wyland | 53/376 |
| 3,754,374 | 8/1973 | Haines | 53/373 |
| 3,773,250 | 11/1973 | Phillips | 206/538 |
| 3,775,941 | 12/1973 | Bross | 53/246 |
| 3,780,856 | 12/1973 | Braverman | 206/56 AB |
| 3,789,575 | 2/1974 | Bross | 53/160 |
| 3,809,221 | 5/1974 | Compere | 206/461 |
| 3,835,995 | 9/1974 | Haines | 206/42 |
| 3,874,143 | 4/1975 | Braber | 53/14 |
| 3,897,855 | 8/1975 | Patterson | 206/538 |
| 3,913,734 | 10/1975 | Siegel | 206/498 |
| 3,924,748 | 12/1975 | Braverman | 206/534.1 |
| 4,065,000 | 12/1977 | Murton | 214/1 |
| 4,101,284 | 7/1978 | Difiglio et al. | 23/259 |
| 4,122,651 | 10/1978 | Braverman | 53/390 |
| 4,277,024 | 7/1981 | Spector | 239/36 |
| 4,289,258 | 9/1981 | Ransom | 222/308 |
| 4,295,409 | 10/1981 | Simpson | 86/31 |
| 4,295,565 | 10/1981 | Takeuchi | 312/71 |
| 4,387,831 | 6/1983 | McNally | 221/70 |
| 4,411,205 | 10/1983 | Rogers | 111/1 |
| 4,446,672 | 5/1984 | Raudat | 53/448 |
| 4,460,106 | 7/1984 | Moulding, Jr. et al. | 221/1 |
| 4,574,954 | 3/1986 | Reid | 206/531 |
| 4,586,316 | 5/1986 | Backman et al. | 53/449 |
| 4,627,225 | 12/1986 | Faller et al. | 53/510 |
| 4,648,530 | 3/1987 | Granger | 221/155 |
| 4,664,262 | 5/1987 | White | 206/531 |
| 4,685,271 | 8/1987 | Ringer et al. | 53/246 |
| 4,693,057 | 9/1987 | Rittinger et al. | 53/539 |
| 4,694,996 | 9/1987 | Siegel | 241/100 |
| 4,730,849 | 3/1988 | Siegel | 283/70 |
| 4,732,411 | 3/1988 | Siegel | 283/75 |
| 4,750,315 | 6/1988 | Wadell | 53/475 |
| 4,776,150 | 10/1988 | Siegel | 53/329 |
| 4,813,753 | 3/1989 | Relyea | 312/291 |
| 4,834,264 | 5/1989 | Siegel et al. | 221/200 |
| 4,958,736 | 9/1990 | Urheim | 206/531 |
| 5,014,851 | 5/1991 | Wick | 206/539 |
| 5,394,670 | 3/1995 | Visser | 53/249 |
| 5,404,693 | 4/1995 | Giovannone | 53/453 |
| 5,419,099 | 5/1995 | Mueller et al. | 53/473 |
| 5,450,710 | 9/1995 | Jensen et al. | 53/475 |
| 5,542,236 | 8/1996 | Miller | 53/467 |
| 5,642,906 | 7/1997 | Foote et al. | 283/67 |

DISPENSING CONTAINER FOR USE WITH ONE OR MORE STRIP PACKAGES OF MEDICATION

BACKGROUND OF THE INVENTION

The present invention relates in general to a dispensing container and more specifically to a disposable dispensing container for strip packages used to package and dispense medication. The dispensing container and packaging of this invention is an improvement over packaging in that it allows a strip package or packages of medication to be easily stored in strips that can be stored in a serpentine fashion within the dispensing container and dispensed from the container while the strip is in its serpentine arrangement. The container itself may be stored and carried within a drawer of a standard medication cart or "pill cart" typically utilized by pharmacists, nursing professionals, other professionals and facilities, including acute care facilities.

These "pill carts" have drawers typically dimensioned for the storage and transportation of 9"×6" card packages of medication (e.g. "pill cards" or "blister cards"). A drawback of dispensing packaging and containers for strips of pills relates to the lack of an efficient means to daily dispense the medication from the pill strips to the patients as the size and drawer dimensions of pill or medication carts will not allow accommodation of other medical packaging or containers.

Preferred embodiments of the dispensing container of the present invention are dimensioned such that both single and multi-unit configurations of the present invention are capable of fitting within the confines of these "pill cart" drawers while still allowing easy access to the medication. The present invention overcomes another drawback of the packaging and pill strip dispensing systems by providing pharmacists, nursing professionals, and/or acute facilities with the option of dispensing strip packages of medication or card packages of medication from the same medication cart without having to modify the physical dimensions of the drawers themselves.

Current Food and Drug Administration (F.D.A.) regulations introduce another drawback into the packaging, storage and distribution of medications. These regulations may require that partially used multi-dose "pillcards" or "blister cards" cannot be re-used and must be destroyed. The unused individual pills on each "pillcard" can be re-used only if the cards are cut open and the pills re-packaged in a new "pillcard" with the required F.D.A. markings.

However, partially used strip packages of medication can be re-used without having to undergo the additional expenses of repackaging required with card packages of medication.

SUMMARY OF THE INVENTION

Accordingly, it is an object of the present invention to provide a dispensing container, capable of enclosing strip packages of medication and allowing relatively easy dispensing of the medication, which is dimensioned such that the dispensing unit is capable of being stored and transported within a drawer of a medication cart without necessitating substantial modification to the drawer.

Another object of the present invention is to provide a dispensing container having regulating means, which allows the strip package of medication, once accessed, to be held in an upright position for removal of only the "next pill enclosure" while resisting movement of the strip package of medication back into the dispensing container once removed.

A further object of the present invention is to provide a dispensing container capable of accommodating both single and multi-dose packages of medication.

Still another object of the present invention is to provide a dispensing container capable of also holding either more or less than the typical 30/31 day supply of strip packages of medication. Therefore, this allows the use of 7 day or 14 day strips or any other combination of day of days of medication, thereby reducing waste that results from use of other forms of medication dispensing.

Still a further object of the present invention is to provide a dispensing container which can be configured as either a single-unit or as a multi-unit design, utilizing grouping means, for combining single-units into various configurations which are still capable of being stored and transported within a drawer of a medication cart without necessitating substantial modification to the drawer.

Still another object of this invention is to provide a dispensing container having means for facilitating the distribution of medication, such as, for example, during the most commonly utilized time intervals in which medication is routinely dispensed to a patient.

Yet a further object of this invention is to provide a dispensing container having accessing means which allows the strip package of medication to be removed from the dispensing container without the dispensing container having to be removed from the drawer of the medication cart.

Yet another object of this invention is to provide a dispensing container with identification means for identifying the quantity of medication remaining within an already accessed container.

Yet a further object of this invention is to provide a dispensing container encompassing various security measures to prevent tampering and ensure the integrity of the medication.

To accomplish the foregoing and other objects of the dispensing container of this invention there is provided one more containers for storing and dispensing one or more strip packages of medication.

The container or containers of the present invention and their equivalents, hereinafter "container" or "the container" comprise means for enclosing strip packages of medication. The enclosing means are dimensioned such that the one or more containers are capable of being received within a medication cart.

The container comprises means for accessing the strip packages of medication from within the confines of the enclosing means without having to remove the container from the medication cart.

The container comprises means for regulating the distribution of the strip packages of medication. The regulating means allow the strip packages of medication to be removed from the accessing means while resisting re-insertion of the strip packages of medication after their removal.

The container comprises means for facilitating the distribution of medication during the most commonly utilized time intervals in which medication is routinely dispensed to a patient.

The container comprises means for substantially identifying the quantity of strip packages of medication remaining within the enclosing means of an already accessed container.

The container comprises means for grouping a plurality of containers together to facilitate distribution of medication and/or to maximize efficiency of the medication cart.

These and other objects and features of the present invention will be better understood and appreciated from the following detailed description of preferred embodiments thereof, selected for purposes of illustration and shown in the accompanying drawings.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
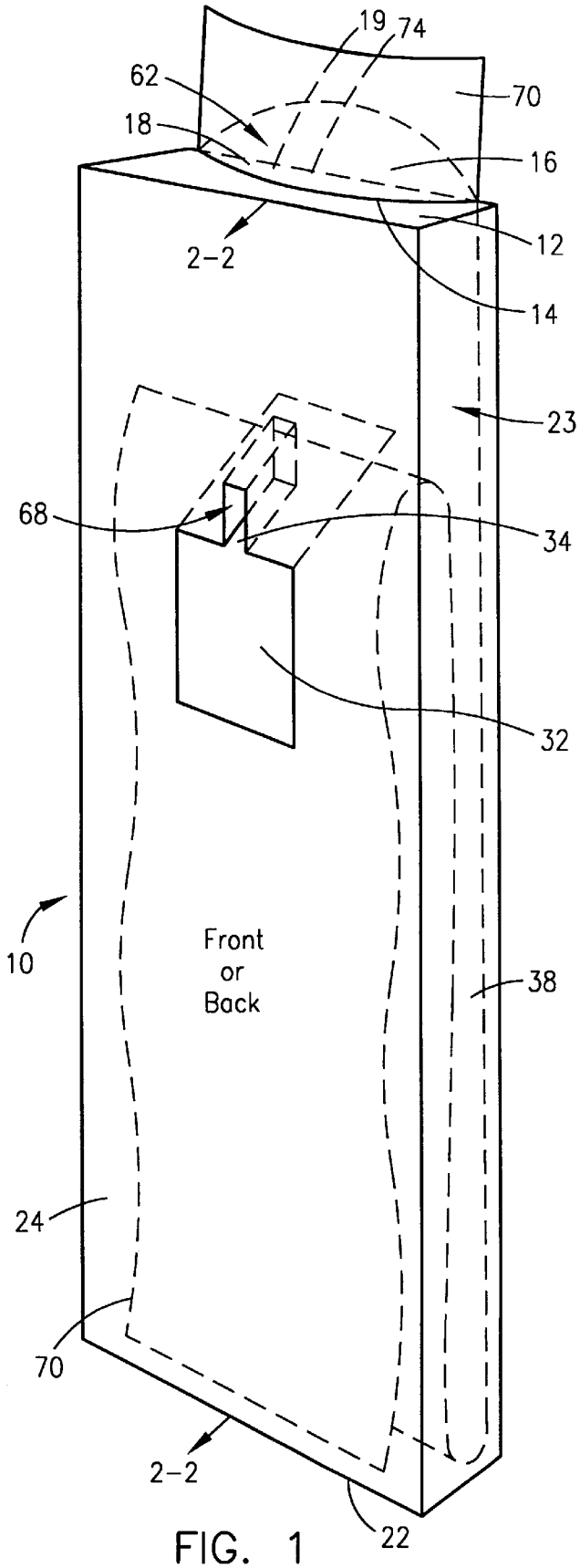
FIG. 1 is a perspective view of one embodiment of an assembled dispensing container of the present invention.
Figure 2C:
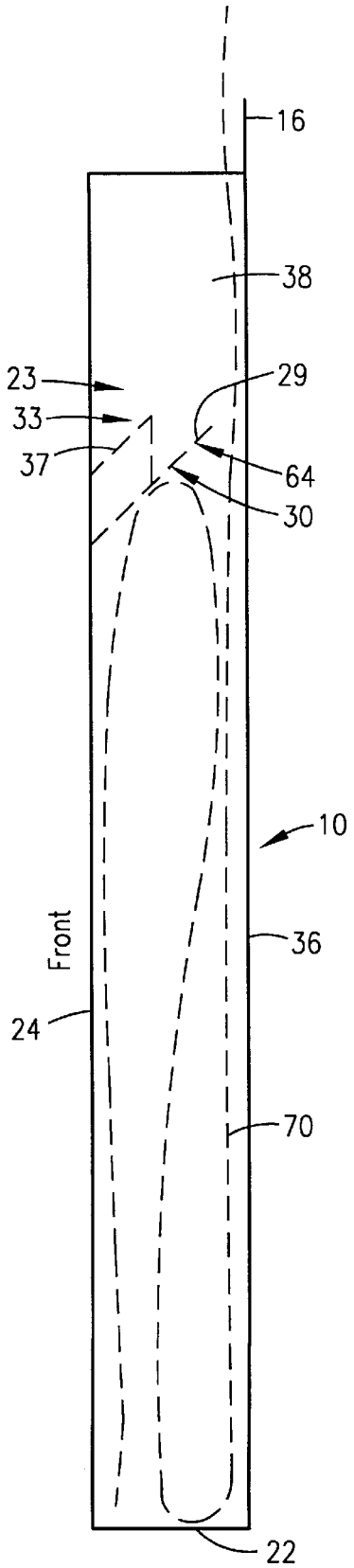
FIG. 2*a,* 2*b,* 2*c* are cross-sectional views taken along line 2—2 in FIG. 1.
Figure 2A:
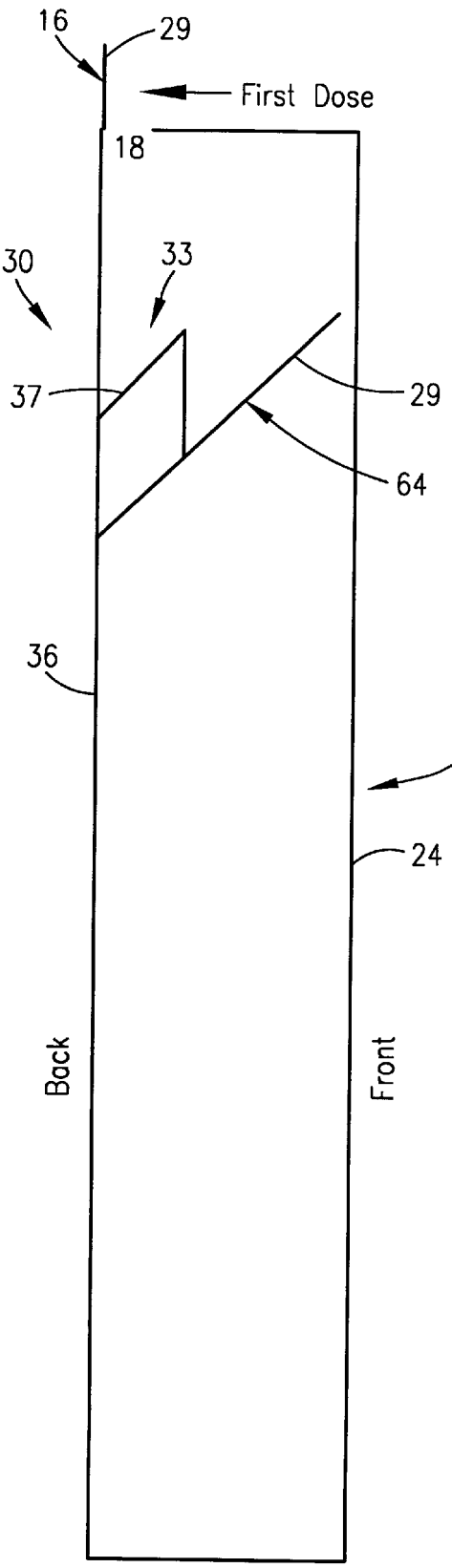
Figure 2B:
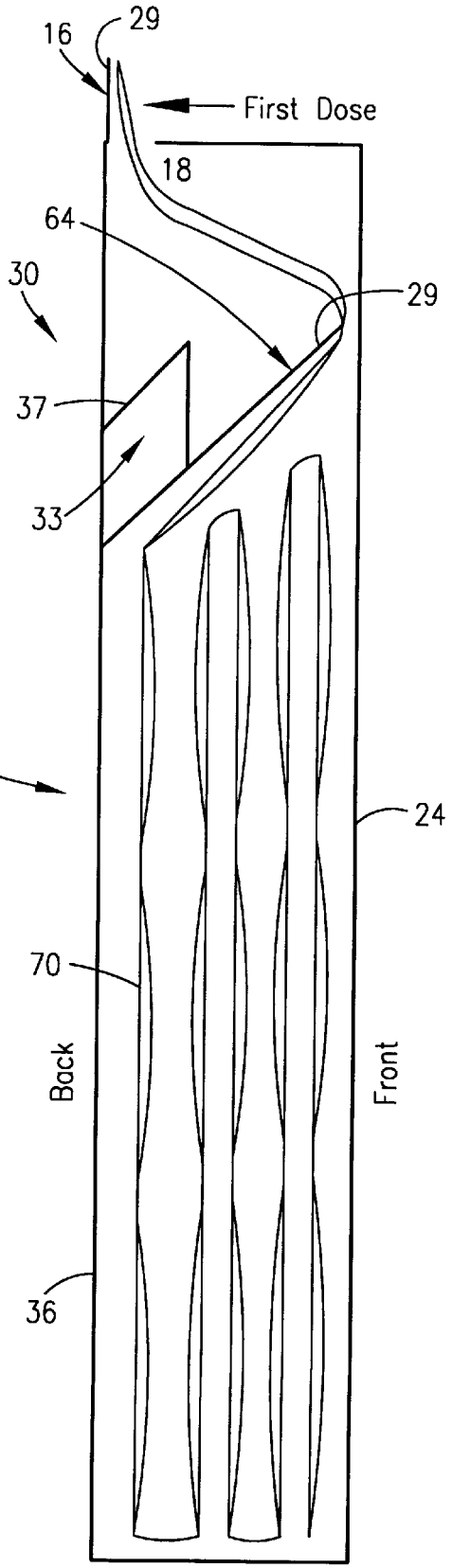
Figure 4:
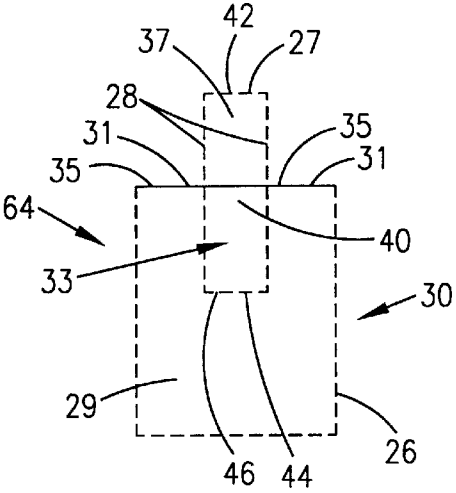
FIG. 4 is a plan view of regulating means of one preferred embodiment of the present invention.
Figure 5:
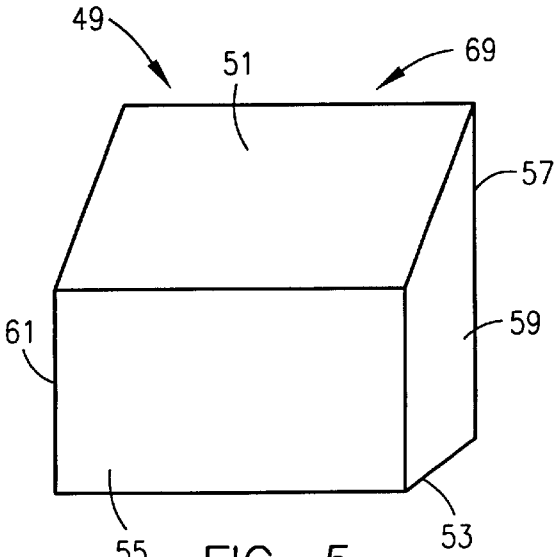
FIG. 5 is a perspective view of a package for a dispensing container of the present invention.

Referring now to the drawings there are shown preferred embodiments for the dispensing container of this invention. The dispensing container is described in connection with a medication application in which one or more dispensing containers, for storing and dispensing one or more strip packages of medication, are utilized with a medication cart which in the past has been typically configured for and utilized with 9"×6" pillcards. The dispensing container described herein and its equivalents are particularly adapted to fit within the confines of these medication carts which provide pharmacists, nursing professionals, and/or acute care facilities with medicine dispensing options.

The drawings show one preferred embodiment of the dispensing container 10 in conjunction with strip packages of medication 70. The strip packages of medication 70 typically encompass a 30/31 day supply; however strip packages 70 holding less than the traditional 30/31 day supply, such as a 15 or a 7 or a 14 day supply of medication. The present invention accommodates just about any period of medication from the monthly dosages to the daily dosages and anything in between that is required. Therefore, it will be understood that any number of days supply can also be inserted into the dispensing container 10. Additionally, the dispensing container 10 can accommodate single and/or multiple dose strip packages of medication 70.

The dispensing container 10 consists of enclosing means 23 for enclosing the strip packages of medication 70, accessing means 62 for accessing the strip packages of medication 70 from within the enclosing means 23 without having to remove the dispensing container 10 from the medication cart, and regulating means 64 for regulating the dispensing of the medication such that the strip packages of medication 70 can be readily removed but are resisted against reinsertion back through the accessing means 62.

Figure 3:
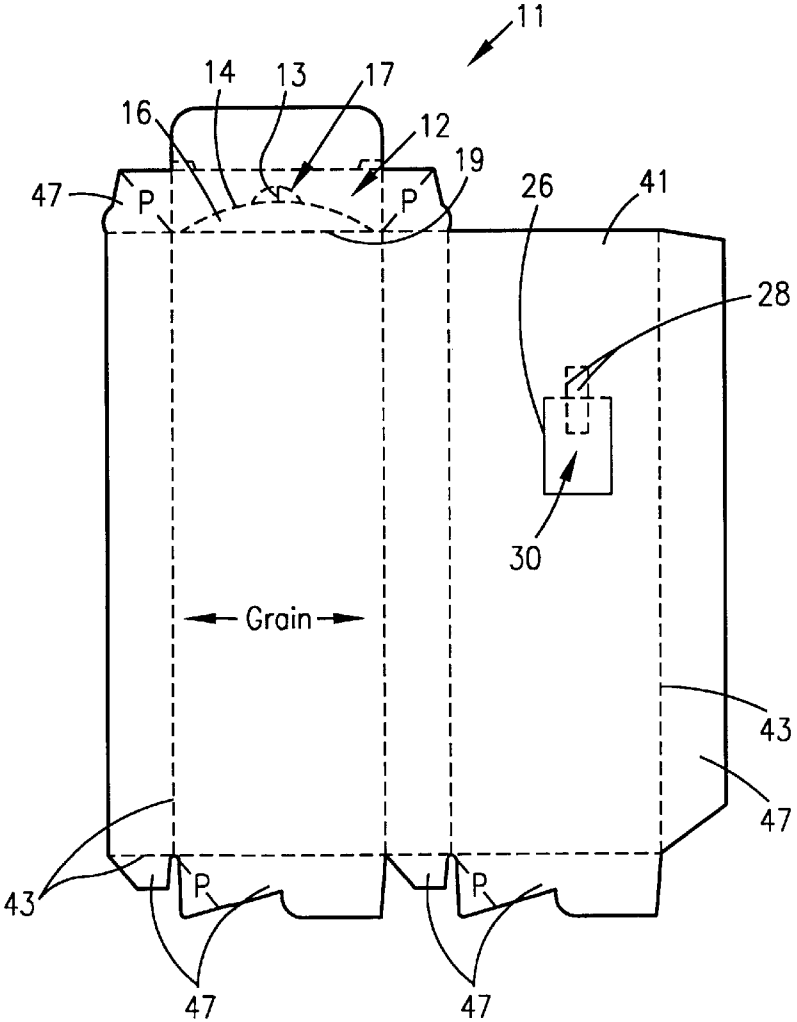
FIG. 3 is a plan view of one unassembled embodiment of the dispensing container.

As shown in FIG. 3, the dispensing container 10 is manufactured from a panel member 41 having a plurality of fold lines 43, a plurality of score lines 45, and a plurality of tabs 47. During assembly, the panel member 41 is folded along the plurality of fold lines 43 and the plurality of tabs 47 are glued together after the strip packages of medication have been folded into a serpentine-type pattern and inserted into the dispensing container 10.

The enclosing means 23 consists of a top 12, a bottom 22, a front 24, a back 36 opposite the front 24, a first side 38, and a second side 39 opposite the first side 38.

In variations of preferred embodiments of the present invention, the top 12 of the enclosing means 23 includes a top flap 16 substantially defined by an arcuate score line 14 and a first edge margin 19 between the top 12 and the back 36; and a thumb notch 17 substantially defined by a portion 25 of the arcuate score line 14 and a second edge margin 21. The thumb notch is bisected by a linear score line 13 also substantially bisecting the arcuate score line 14. The score lines partially cut through the panel member 41 such that they can be easily broken by an end-user when accessing the medication.

The top 12 of the enclosing means 23 may contain facilitating means 66 for facilitating the distribution of medication during the most commonly utilized time intervals in which medication is routinely dispensed to a patient. In one preferred embodiment, the facilitating means 66 comprises color coding 20 corresponding to these dispensing times.

Figure 6:
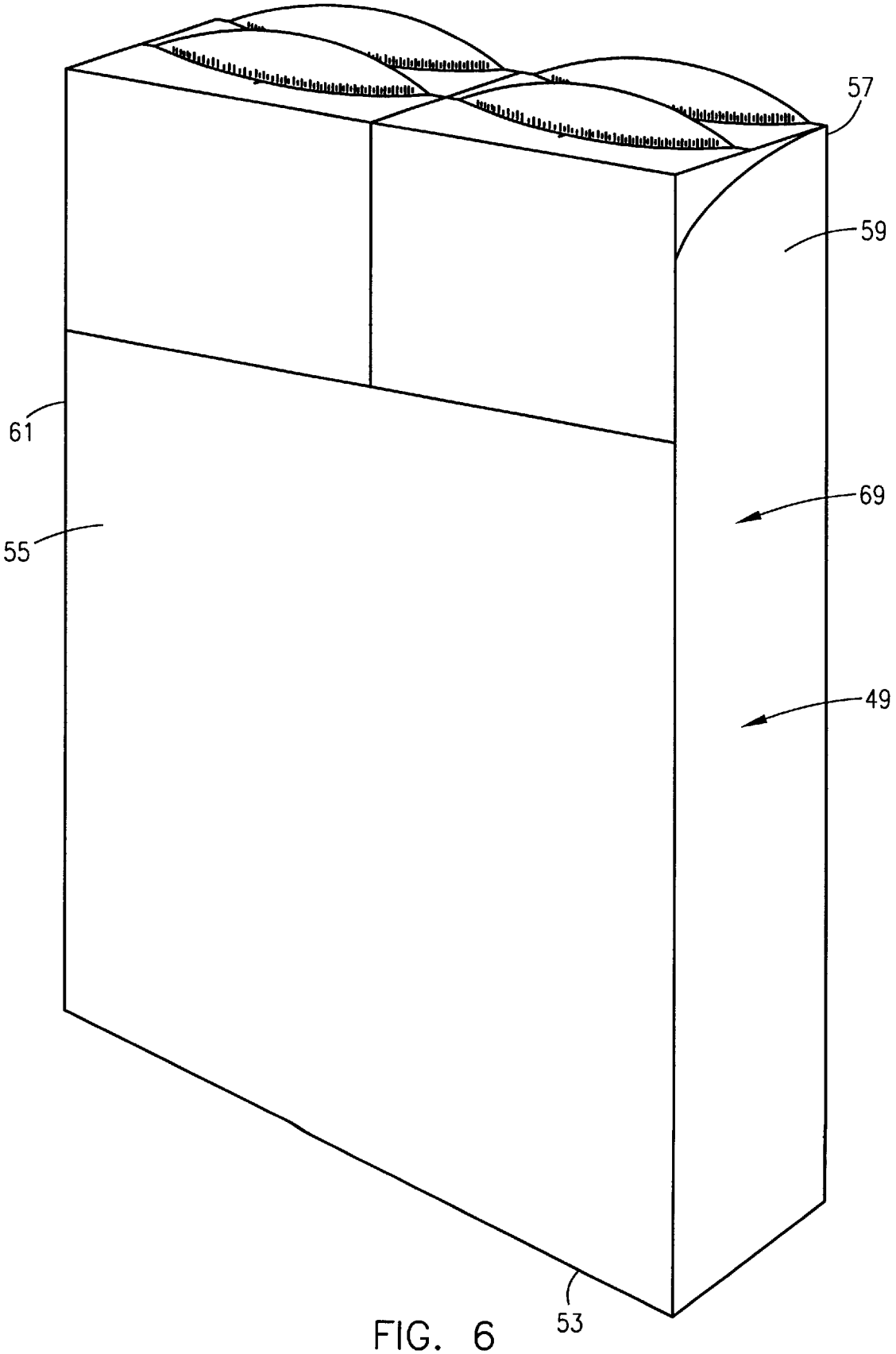
FIG. 6 is a perspective view of a package for four (4) dispensing containers of the present invention.
Figure 7:
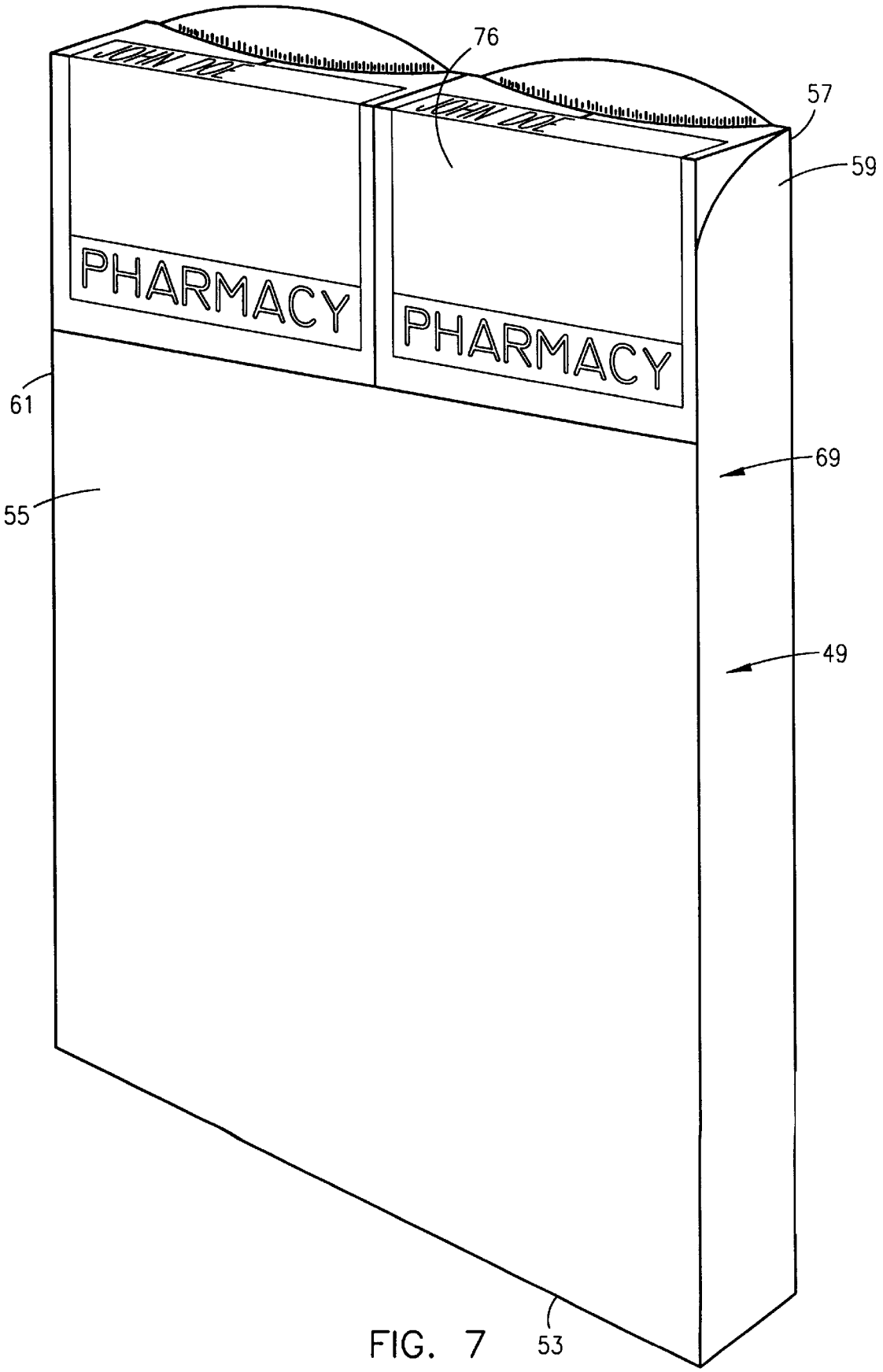
FIG. 7 is a perspective view of a package for two (2) dispensing containers of the present invention.

The most popular medication dispensing times typically include: 1) Morning-(A.M.), (2) Noon, (3) Afternoon-(P.M.), and (4) Bedtime. FIG. 6 illustrates another preferred embodiment of the present invention in which four dispensing containers 10 are grouped together to represent the four most popular medication dispensing times.

In a preferred embodiment, the back 36 of the enclosing means 23 includes a flap 29 defined by a U-shaped score line 26 and an edge margin 31 between the back 36 and the flap 29; and a tab 37 defined by a pair of parallel score lines 28 proximate the flap 29, an edge margin 27 between the back 36 and the tab 37, and an edge margin 44 between the flap 29 and the tab 37.

In another preferred embodiment, the front 24 of the enclosing means 23 includes the flap 29 as opposed to the back 36 of the enclosing means 23 in the previously described preferred embodiment. In this preferred embodiment, the flap 29 is defined by the U-shaped score line 26 and an edge margin 50 between the front 24 and the flap 29; and the tab 37 defined by the pair of parallel score lines 28 proximate the flap 29, an edge margin 52 between the back 36 and the tab 37, and an edge margin 54 between the flap 29 and the tab 37.

In both the preferred embodiments, the front 24 of the enclosing means 23 may also contain facilitating means 66, such as color coding 20, for facilitating the distribution of medication during the most commonly utilized time intervals in which medication is routinely dispensed to a patient.

Also, in both the preferred embodiments, the accessing means 62 includes a semi-circular opening 18 of the top 12 created when an end user depresses the thumb notch 17, thereby breaking the linear score line 13 and partially breaking the arcuate score line 14, and lifts the top flap 16, thereby completely breaking the arcuate score line 14. The thumb notch 17 pivots about the second edge margin 21 establishing a pivot point 72 and the top flap 16 pivots about the first edge margin 19 establishing a pivot point 74. The strip package of medication 70 is capable of passing through the semi-circular opening 18 allowing uncomplicated access by a user. The top opening facilitates use of the present invention with the medication cart having drawers which in the past has been typically configured for and utilized solely with and for 9"×6" pill cards.

The regulating means 64 in a preferred embodiment comprises a one-way valve 30 including the flap 29 in combination with spring means 33. In a preferred embodiment, the spring means 33 comprises the tab 37.

When an end user depresses the flap 29 and tab 37 combination, the U-shaped score line 26 and the pair of parallel score lines 28 are broken, and the flap 29 can be pushed inward and upward against the strip package of medication 70 contained by the enclosing means 23. The flap 29 pivots about the edge margin 31 establishing a pivot point 35. The tab 37 folds at fold line 40 and pivots about the edge margin 27 and the edge margin 44 establishing pivot points 42 and 46, respectfully. The tab 37 when folded and pivoted as such effectively creates a spring means 33. The spring means 33 in combination with the now angled flap 29 contacts the strip package of medication 70 and holds the strip package of medication in an upright position while effectively locking the strip package of medication 70 such that the strip package of medication 70 can be readily removed while at the same time resisting re-insertion back through the semi circular opening 18.

In a preferred embodiment, when the flap 29 is included in the back 36 of the dispensing container 10, the regulating means 64 urges the strip package of medication 70 toward the front 24 of the dispensing container 10 opposite the opening 18 of the top 12 of the dispensing container 10. This preferred embodiment blocks or regulates the strip packages of medication 70 from being pulled out of the opening 18 thereby providing for removal of only the "next pill enclosure" rather than multiple pill enclosures which would be hindered from being re-inserted.

In another preferred embodiment, the flap 29 is included in the front 24 of the dispensing container 10. This preferred configuration resists the strip packages of medication 70 from being pulled out of the opening 18 thereby allowing for pulling the "next pill enclosure" out rather than multiple pill enclosures.

In the other preferred embodiment, when the flap 29 is included in the front 24 of the dispensing container 10, the regulating means 64 urges the strip package of medication 70 toward the back 36 of the dispensing container 10 and in alignment with the opening 18 of the top 12 of the dispensing container 10. This other preferred embodiment configuration allows the strip packages of medication 70 to be more easily pulled out of the opening 18 with minimal blockage or regulation. In this preferred embodiment configuration, it seems requires more care during use to ensure that multiple pill enclosures, rather than just the "next pill enclosure," are not pulled out of the opening 18.

In the embodiments of the present invention, one or more dispensing containers 10 can be packaged together utilizing grouping means 69 for grouping a plurality of dispensing containers 10 together to facilitate distribution of medication and/or to maximize efficiency of the medication cart. In one preferred embodiment, the grouping means 69 comprises a sleeve member 49 having a closed bottom 53,the open top 51 for receiving the plurality of dispensing containers 10, a partially open front 55 for increased visibility and access, a closed back 57, a partially open first side 59 for increased visibility and access, and a partially open second side 61 opposite the first side 59 for increased visibility and access.

In one preferred embodiment, the sleeve member 49 is capable of grouping four (4) dispensing containers 10, two (2) across and two (2) deep in quadrant-like fashion. Such an embodiment is seen as being utilized in conjunction with the four (4) most popular medication dispensing times. The sleeve members 49 are dimensioned such that these multi-unit configurations can still be utilized with the medication cart.

In another preferred embodiment, the sleeve member 49 is capable of grouping two (2) dispensing containers 10, typically two (2) across. Such an embodiment is seen as being utilized, for example, with acute patients who typically need less than a 30/31 day supply of any one medication and routinely require different medications. These double sleeve members 49 are also dimensioned such that they can still be utilized with the medication cart.

In the preferred embodiments described herein and their equivalents, the dispensing container 10 further includes identification means 68 for substantially identifying the quantity of strip packages of medication 70 remaining within the enclosing means 23 of an already accessed dispensing container 10.

In one preferred embodiment, the identification means 68 comprises a long narrow slot, such as a notch 34 formed when depressing the tab 37 of the spring means 33, in combination with the opening 32 formed when depressing the flap 29. A user can visually see the quantity of medicine remaining through the notch 34.

In one preferred embodiment, the dispensing means 10 is 0.016 inch thick and comprised of SBS material.

In one preferred embodiment, the physical dimensions of one assembled dispensing container 10 is approximately 8.50 inches tall, approximately 2.94 inches wide, and approximately 0.94 inches deep. In multi-unit configurations with sleeve members 49, a grouping of four (4) dispensing containers 10, two (2) across and two (2) deep in quadrant-like fashion is approximately 8.50 inches tall, approximately 6.00 inches wide, and approximately 2.00 inches deep; a grouping of two (2) dispensing containers 10, two (2) across, is approximately 8.50 inches tall, approximately 6.00 inches wide, and approximately 1.00 inches deep. The depth of the dispensing container 10 can vary depending upon the quantity and type of medication without effecting its ability to fit within the medication cart.

The physical dimensions of the preferred embodiments of the dispensing container 10 substantially conform to the standard 9.00 inch tall by 6.00 inch wide pill card. As such, the dispensing containers 10 for storing and dispensing one or more strip packages of medication, can be utilized with a medication cart which is typically configured for and utilized with 9"×6" pill cards.

In preferred embodiments, the dispensing container 10 may include various security measures to prevent tampering and attest to the integrity of the medication, for example, the break-open package utilizing score lines. Additionally, the design, as illustrated in FIG. 3, eases loading and prevents access once assembled. Also, the dispensing container 10 may include a roll over label 76 running from top 12 to bottom 22 which seals the container 10 while providing patient and medication information.

In operation, after accessing the medication and setting the regulating means as described above, the user merely places the dispensing container 10 within the drawer of the medication cart and dispenses medication as required. In one preferred embodiment, the package of the present invention is used by manufacturers, assemblers and fillers of pill strips for packaging the pill strips for sale or distribution to individuals and organizations needing to dispense pill strips and already in possession of medications carts with drawers suitable for use with pill cards, including blister package pill cards.

While preferred and alternate embodiments have been illustrated and described, variations may be possible. The depth of the dispensing container may be changed to suit the type and quantity of medication. Although the preferred embodiments of the dispensing container of this invention are illustrated as rectangular, the shape could be altered to suit a particular application while still incorporating the present invention.

The material composition may also be altered, changed or modified without departing from the present invention.

Having described the invention in detail, those skilled in the art will appreciate that modifications may be made to the invention without departing from its spirit therefore, it is not intended that the scope of the invention be limited to the specific embodiment illustrated and described. Rather, it is intended that the scope of this invention be determined by the claims and their equivalents.

What is claimed is:

1. A container for storing and dispensing strips, comprising:

means for enclosing a strip-like package;

means for regulating the withdrawal of at least a portion of the strip-like package from the means for enclosing the strip-like package through the means for accessing the strip-like package, the means for regulating including a one-way valve;

a top portion having a top flap portion, a bottom portion, a front portion, a back portion having a flap portion and a tab portion, a first side portion, and a second side portion opposite the first side portion; and the one-way valve defined by the flap portion of the back portion in combination with means for providing spring biasing of the strip-like package away from the back portion.

2. A container for storing and dispensing strips, comprising:

means for enclosing a strip-like package;

means for regulating the withdrawal of at least a portion of the strip-like package from the means for enclosing the strip-like package through the means for accessing the strip-like package, the means for regulating including a one-way valve;

a top portion having a top flap portion, a bottom portion, a front portion having a flap portion and a tab portion, a back portion opposite the front portion, a first side portion, and a second side portion opposite the first side portion; and the one-way valve defined by the flap portion of the front portion in combination with means for providing spring biasing of the strip-like package away from the front portion.

3. A container for storing and dispensing strip packages of medication, comprising:

means for enclosing strip packages of medication including a top having a top flap, a bottom, a front, a back having a flap and a tab, a first side, and a second side opposite the first side, wherein the enclosing means and the container are capable of being received within a medication cart;

means for accessing the strip packages of medication from within the confines of the enclosing means without having to remove the container from a medication cart receiving the container, the accessing means including an opening in the top of the enclosing means created by lifting the top flap; and means for regulating the distribution of the strip packages of medication including a one-way valve, wherein the regulating means provides for allowing the strip packages of medication to be removed from the accessing means and resisting re-insertion of the strip packages of medication into the container after their removal from the interior of the container.

4. A container as set forth in claim 3 wherein the top of the enclosing means further comprises a thumb notch.

5. A container as set forth in claim 3 wherein the flap of the back of the enclosing means is defined by a U-shaped score line and an edge margin between the back and the flap, wherein the tab is defined by a pair of parallel score lines proximate the flap, an edge margin between the back and the tab, and an edge margin between the flap.

6. A container as set forth in claim 3 wherein the enclosing means is dimensioned such that both the front and the back are approximately 8.50 inches tall and approximately 3.00 inches wide.

7. A container as set forth in claim 3 wherein the opening of the accessing means is provided by a semi-circular score line and formed by breaking the score lines and lifting the top flap of the enclosing means.

8. A container as set forth in claim 3 wherein the one-way valve of the regulating means further comprises the flap of the back in combination with a spring means.

9. A container as set forth in claim 8 wherein the spring means further comprises the tab of the back of the enclosing means.

10. A container as set forth in claim 3 further comprising:

means for identifying the quantity of strip packages of medication remaining within the enclosing means of an already accessed container, the identifying means comprising a notch, formed when depressing the tab of the back of the enclosing means; in combination with an opening, formed when depressing the flap of the back of the enclosing means.

11. A container as set forth in claim 3 further comprising:

means for grouping a plurality of containers together to facilitate distribution of medication so as to retro-fit operation of the medication cart, wherein the grouping means further comprises a sleeve member.

12. A container as set forth in claim 3 further comprises:

means for facilitating the distribution of medication during the most commonly utilized time intervals in which medication is routinely dispensed to a patient, wherein the facilitating means comprising color coding corresponding to the time intervals.

13. A container as set forth in claim 3 wherein the top flap is defined by an arcuate score line and a first edge margin between the top and the back of the enclosing means.

* * * * *